United States Patent [19]

Armstrong et al.

[11] 4,207,120

[45] Jun. 10, 1980

[54] PRODUCTION OF METAL COMPACTS

[75] Inventors: Brian M. Armstrong; Kenneth J. King, both of Sheffield, England

[73] Assignee: British Steel Corporation, London, England

[21] Appl. No.: 960,027

[22] Filed: Nov. 13, 1978

[30] Foreign Application Priority Data

Nov. 15, 1977 [GB] United Kingdom ..... 47450/77

[51] Int. Cl.[2] ..... C21D 1/48

[52] U.S. Cl. ..... 148/16.5; 75/200; 75/211; 148/126

[58] Field of Search ..... 75/200, 211; 148/16.5, 148/126

[56] References Cited

U.S. PATENT DOCUMENTS

| | | | |
|---|---|---|---|
| Re. 22,452 | 3/1944 | Clements et al. | 148/126 |
| 2,489,838 | 11/1949 | Webb | 75/200 |
| 4,063,940 | 12/1977 | Dain et al. | 148/126 |
| 4,153,485 | 5/1979 | Ogata et al. | 75/211 |

*Primary Examiner*—L. Dewayne Rutledge
*Assistant Examiner*—John P. Sheehan
*Attorney, Agent, or Firm*—Jesse B. Grove, Jr.

[57] ABSTRACT

The invention relates to the continuous production of steel compacts in strip form from as-atomized stainless steel powder. A porous green compact of stainless steel powder having a carbon content not exceeding 0.06% by weight is through-carburized to raise its carbon content to a level in excess of that required in the product and then subsequently heat treated in a reducing atmosphere to promote chemical reaction between the carbon and oxygen present in the compact to reduce the former to a level not exceeding 0.03% by weight and the latter by a factor of two. Through-carburizing and reduction may be effected in successive zones 2,3 of a continuous floatation furnace 1.

6 Claims, 2 Drawing Figures

Figures 1, 2:
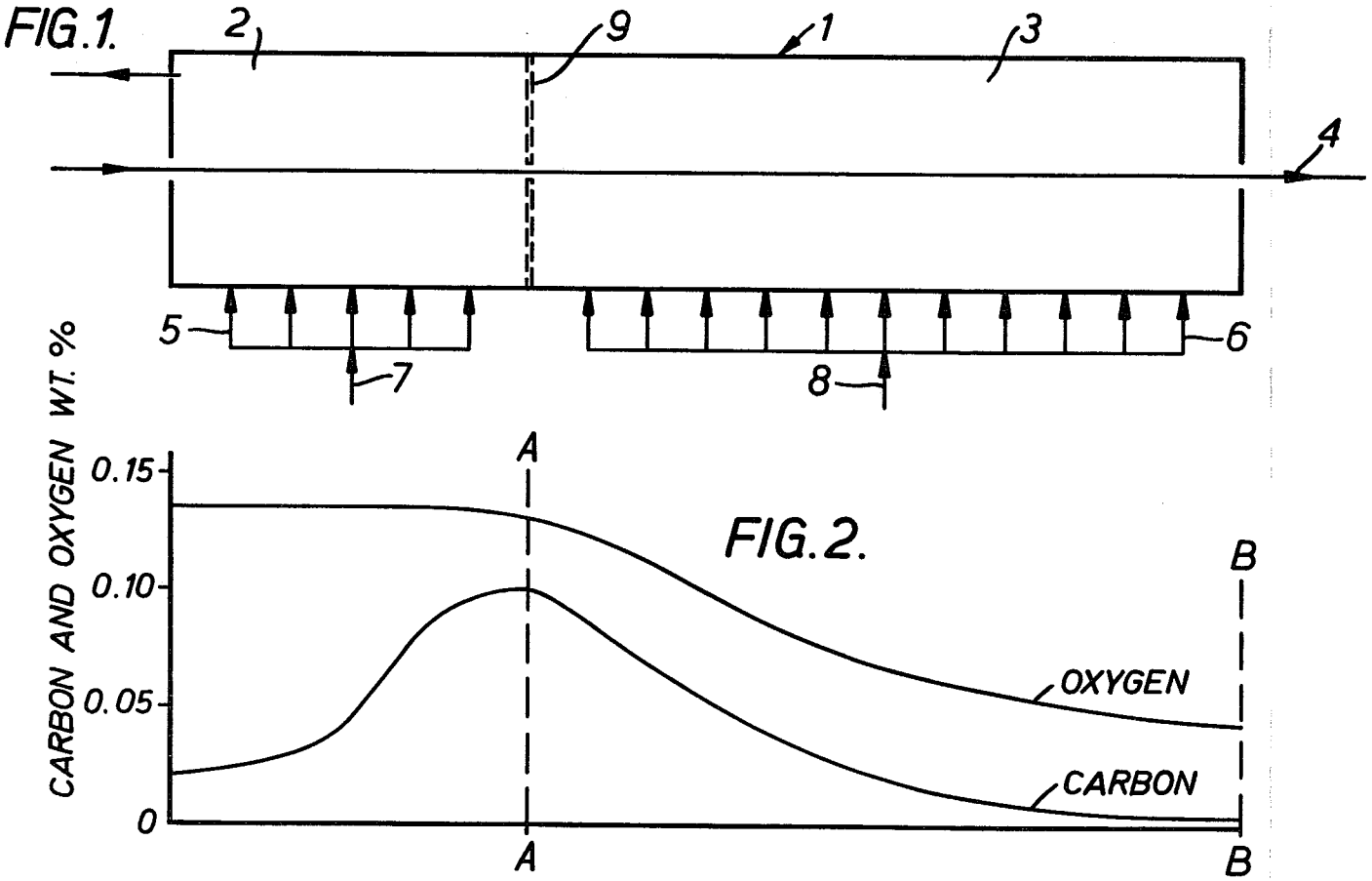

1
2
3
4
5
6
7
8
9

A
A
B
B
OXYGEN
CARBON
0.15
0.10
0.05
0
CARBON AND OXYGEN WT. %

PRODUCTION OF METAL COMPACTS

This invention relates to the production of steel strip compacts and especially to the production of such compacts from as-atomised stainless steel powder.

It is known to produce stainless steel powder by water atomisation techniques. The oxygen contents of powders so produced tend to be relatively high (conventionally above 2500 parts per million), with the consequence that the oxygen content of the product may be too high for the development of the best properties. This is particularly true for steel strip where the mechanical properties and particularly the stretch formability of the product are adversely affected by high residual oxygen contents.

It has been proposed previously to reduce the residual oxygen content of porous green strip produced by roll compacting water atomised steel powder by reaction during sintering with carbon present in the strip. To this end it has been suggested that the initial carbon content of the metal from which the powder is produced be deliberately increased to provide the carbon necessary to reduce during sintering the residual oxygen present in the green strip. Increasing the carbon content of the steel, however, produces a powder having a high carbon content leading, in the case of ferritic stainless steels, to poor compressibility giving high mill loads during compaction and poor stress sensitivity during sintering. These disadvantages can be overcome by annealing the powder prior to compaction but only at additional expense. The addition of carbon at the melting stage furthermore makes control of the final carbon and oxygen contents in the product difficult for several reasons. Firstly, accurate control of carbon in the melt is difficult; secondly it is difficult to predict the amount of oxide formed on atomisation, and thirdly, where annealing is necessary, the losses in carbon and losses or gains in oxygen are also difficult to predict. It is therefore impracticable to ensure both low oxygen and carbon levels after processing of the powder product. The residual carbon level is particularly important in stainless steels because of general corrosion problems and particularly the dangers of intergranular corrosion in welded austenitics and the production of brittel matensitic structures in welded ferritics.

It has also been proposed to increase the carbon content of the powder by making graphite powder additions to the steel powder prior to compaction. While such additions overcome the problem of poor compressibility, segregation of the mixed powders both during blending and later during pouring for compaction, has led to inconsistencies in analysis of the final strip product, and, on occasions, localised melting in areas high in carbon during sintering.

The present invention sets out to overcome these disadvantages by employing separate carburising and oxygen-reduction treatment operations. The green strip compact is sintered in a carburising atmosphere to increase its carbon content to the desired level for oxygen reduction and subsequently sintered in a reducing atmosphere to promote chemical reaction between the excess carbon and oxygen contents of the strip to reduce their levels. This two stage treatment provides a stainless steel powder product with a significantly lower oxygen content than could otherwise be achieved without expensive vacuum treatment or lengthy and expensive treatment in a low dewpoint gas atmosphere, combined with a low residual carbon content.

The process is particularly suited to strip production because the carbon can be added in an accurately controlled and uniform way in a very short period of time as the first part of the sintering operation.

According to the present invention in one aspect there is provided a method of continuously producing stainless steel strip compacts which comprises the sequential steps of compacting as-atomised stainless steel powder having a carbon content no greater than 0.06% by weight to produce a porous green strip compact, through-carburising the green compact to disperse carbon uniformly around the boundaries of the powder particles which made up the compact so increasing the carbon content of the compact to a level in excess of that required in the finished product and, heat treating the through-carburised green compact in a reducing atmosphere to promote chemical reaction between the carbon and oxygen present in the compact to reduce the former to not more than 0.03% by weight and the latter by a factor of at least two.

The steel powder may be compacted within the nip of a pair of contra-rotating compaction rolls to produce green strip.

Through-carburising may be effected by heat treating the green compacts in a carburising atmosphere. Such an atmosphere may comprise a hydrocarbon gas, such as methane present in a carrier gas such as argon and hydrogen. The argon and hydrogen may be present as a mixture comprising 80% argon/20% hydrogen. The particular gas composition for carburising will depend upon the temperature distribution of the furnace and the strip dimensions and throughput.

The reducing atmosphere may comprise hydrogen or a mixture of hydrogen and argon. The hydrogen/argon mixture employed may consist of 80% argon and 20% hydrogen.

The green strip compact may be conveyed to a sinter furnace in which it is subjected sequentially to a through-carburising treatment followed by a reducing treatment. By reducing treatment is meant a decarburising/deoxidation treatment.

Preferably the sinter furnace comprises a single heating chamber, carburising gas being introduced into that zone of the furnace adjacent the strip compact entry and the reducing gas to the remaining portion of the furnace. In this arrangement the direction of flow of the gas is maintained counter to the direction of travel of strip compact, gas being removed from the furnace at the strip entry end of the furnace. In this way the carburising gas is substantially isolated from the zone containing the reducing gas by the action of the gas flow sweeping the furnace atmosphere towards the entry end of the furnace.

In an alternative arrangement the furnace comprises two heating chambers separated by a seal which minimises leakage of gases from one chamber to the other. In this arrangement the first chamber in the direction of travel of the green strip compact is supplied with carburising gas and a second with reducing gas. In a still further alternative arrangement the strip is sequentially fed through two separate sinter furnaces, the first of which is charged with carburising gas and the second with reducing gas.

Whilst in the sinter furnace(s) the green strip compact may be supported on a gaseous cushion; preferably this gaseous cushion consists within the carburising zone of the furnace(s) of carburising gas and within the reducing zone of the furnace(s) of the reducing gas. The gases are preferably introduced into the furnace chamber(s) through injectors which protrude through one or both side walls of the furnace(s) and which are connected to promote gas circulation within the furnace chamber(s). A proportion of the gas within the or each chamber may be removed from the respective chamber and passed through external ducting including gas conditioning equipment, and are introduced into the respective furnace chamber through the injectors.

According to the present invention in a further aspect, there is provided apparatus for producing stainless steel strip which comprises a compaction mill including a pair of contra-rotating compaction rolls, means for feeding as-atomised stainless steel powder to the nip of the compaction rolls, a sinter furnace for receiving green strip from the compaction mill and having first and second heating zones, means connected to convey controlled quantities of carburising gas to the first heating zone and means connected to convey controlled quantities of reducing gas to the second zone.

The invention will now be described with reference to the following Example of a method of producing a ferritic stainless steel compact in accordance with the invention.

A quantity of water-atomised ferritic stainless steel powder having a composition by weight of 0.035% carbon, 1.54% silicon, 16.98% chromium, 0.41% manganese and 0.13% oxygen, was fed continuously to the nip of a pair of contra-rotating compaction rolls to produce a green strip having a thickness of 1.25 mm and a density of 85% of wrought strip. The green strip was sintered for a period of one minute at 1350° C. in a carburising atmosphere consisting of 80% argon, 16% hydrogen and 4% methane. After sintering the carbon content of the strip was found to have been raised from 0.035% by weight to 0.08% by weight. The oxygen content at this stage was found to remain at 0.13% by weight. On completion of carburisation the carburising atmosphere was removed and replaced by a reducing atmosphere comprising 80% argon and 20% hydrogen. The strip was held in this atmosphere at a temperature of 1350° C. for a period of 2 minutes before being cooled to room temperature within the same atmosphere. During the course of this reduction the oxygen content of the strip was reduced from 0.13% to 0.05% by weight and the carbon content from 0.08% to 0.02% by weight. By contrast when a roll compacted strip of the same composition was sintered for 3 minutes at 1350° C. in a reducing gas of the same composition, without a prior carburisation the oxygen content of the strip was found to be 0.10% by weight. Thus, the reduction in oxygen content achieved by a combination of a carburising stage followed by a reducing stage over that achieved simply by sintering in a reducing atmosphere is substantial and confers significant improvements in formability and corrosion resistance upon the final strip product.

It will be appreciated that in any particular use of the process the carburising potential of the carburising gas can be selected to give a predetermined level of carbon in the compact at the completion of the carburisation phase. The predetermined carbon level will be chosen such that after reaction with the oxygen in the compact in the reduction phase, the residual carbon in the strip product is within the range of composition suitable for its intended use.

The invention will now be described by way of example with reference to the accompanying diagrammatic drawings in which, FIG. 1 is a side elevation of a sinter furnace for heat treating strip in accordance with the invention, and FIG. 2 graphically illustrates the typical carbon and oxygen reactions which occur during operation of the apparatus illustrated in FIG. 1.

Stainless steel powder having a carbon content no greater than 0.06% by weight (preferably less than 0.03% by weight) is passed through the nip of a pair of contra-rotating compaction rolls (not shown) to produce a porous green strip. This strip is conveyed continuously into a sinter furnace similar to that illustrated diagrammatically in FIG. 1. The strip is transmitted through the furnace 1 on a gaseous cushion to minimise the tensile stress applied to the strip during sintering and to eliminate surface contact between the strip and the hearth of the furnace. As will be seen from FIG. 1 the furnace 1 comprises a carburisation zone 2 and an oxygen reduction zone 3; the direction of travel of strip through the furnace is indicated by an arrow 4. The carburisation zone 2 of the furnace is supplied with gas under pressure from a series of injectors 5; similarly, the reduction zone 3 is supplied with gas under pressure from a series of injectors 6. The injectors 5,6 are respectively connected to sources of carburising gas 7 and reducing gas 8. The carburising gas preferably comprises 80% argon/20% hydrogen acting as a carrier gas for a predetermined quantity of a hydrocarbon gas such as methane. The reducing gas preferably comprises 80% argon/20% hydrogen. Intermixing of the carburising gas with the gas in the reducing zone is prevented by ensuring that the direction of gas flow within the chamber is from the exit end towards the inlet end. Alternatively the zones 2 and 3 may be separated by a seal 9 as shown in broken line in FIG. 1.

The carbon and oxygen contents of the roll compacted green strip can be seen from the vertical axis of the graph illustrated in FIG. 2. Whilst in the carburising zone 2 of the furnace, carbon is dispersed uniformly around the boundaries of the powder particles which make up the strip to raise the carbon content of the strip to a value of approximately 0.10% by weight. The oxygen content at this time approximates to 0.13% by weight. These values can be read along the vertical axis A—A of the graph.

The strip now having a carbon content in excess of that required in the finished product passes from the carburising zone 2 and into the reduction zone 3 of the furnace. Whilst it travels through this zone the carbon present in the strip reacts with the undesirably high oxygen content to reduce it by a factor in excess of two to an acceptably low value. As can be read along vertical axis B—B of FIG. 2, on leaving the reduction zone of the furnace the strip had an oxygen content of 0.05% by weight and a carbon content below 0.03% by weight.

It will be appreciated that by suitable control of the carbon potential of the gas existing within the carburising zone 2 of the furnace sufficient carbon can be introduced into the strip to reduce the oxygen content of the roll compacted metal powder to a final controlled level commensurate with the properties required for the strip product.

Although the invention has been described with reference to the production of metallic strip from a green strip product by passing metallic powder through a compaction mill, it is to be understood that other methods of producing the green strip from a power start material could be employed. One such alternative method includes the steps of depositing on a support surface a coating of a slurry comprising a suspension of powdered material in a binder composition, drying the slurry on the support surface to form a dried self-supporting film, removing the dried film from the support surface and rolling the dried film to effect compaction and form a green strip.

It is also to be understood that the invention is not limited to the production of metal strip, thus, for example, individual compacts of strip form may be treated in accordance with the invention.

We claim:

1. A method of continuously producing a stainless steel strip compact which comprises the sequential steps of compacting as atomised stainless steel powder having a carbon content no greater than 0.06% by weight to produce a green strip compact, through-carburising the green compact to disperse carbon uniformly around the boundaries of the powder particles which make up the compact so increasing the carbon content of the compact to a level in excess of that required in the finished product, and heat treating the through-carburised green compact in a reducing atmosphere to promote chemical reaction between the carbon and oxygen present in the compact to reduce the former to a level not exceeding 0.03% by weight and the latter by a factor of at least two.

2. A method as claimed in claim 1 wherein the as-atomished steel powder is fed through the nip of a pair of contra-rotating compaction rolls to produce a continuous length of green strip compact.

3. A method as claimed in claim 1 or 2 wherein through-carburising is effected by heat treating the porous green compact in a carburising atmosphere.

4. A method as claimed in claim 3 wherein the carburising atmosphere comprises a hydrocarbon gas present in a substantially inert carrier gas.

5. A method as claimed in claim 3 wherein the carburising atmosphere comprises methane present in a carrier gas consisting of a mixture of argon and hydrogen.

6. A method as claimed in claim 1 wherein the reducing atmosphere comprises a mixture of argon and hydrogen.

* * * * *